United States Patent [19]

Simonsen

[11] Patent Number: 4,606,505

[45] Date of Patent: Aug. 19, 1986

[54] COMMINUTING MACHINE, ESPECIALLY FOR EMULSIFYING OR FINE COMMINUTING OF MEAT PRODUCTS

[76] Inventor: Knud Simonsen, Strudsbergsvej 44, 4200 Slagelse, Denmark

[21] Appl. No.: 613,041

[22] Filed: May 22, 1984

[30] Foreign Application Priority Data

May 24, 1983 [DK] Denmark ..... 2309/83

[51] Int. Cl.[4] ..... B02C 18/36

[52] U.S. Cl. ..... 241/82.5; 241/162

[58] Field of Search ..... 241/82.2, 82.3, 82.4, 241/82.5, 82.6, 82.7, 162

[56] References Cited

U.S. PATENT DOCUMENTS

| | | | |
|---|---|---|---|
| 643,547 | 2/1900 | Smith | 241/82.6 |
| 4,108,387 | 8/1978 | Weiler | 241/82.5 |
| 4,240,591 | 12/1980 | Schnell | 241/82.5 X |

FOREIGN PATENT DOCUMENTS

| | | |
|---|---|---|
| 0029477 | 6/1981 | European Pat. Off. . |
| 71878 | 10/1892 | Fed. Rep. of Germany . |
| 944235 | 6/1956 | Fed. Rep. of Germany . |
| 515578 | 12/1939 | United Kingdom . |
| 2002224 | 8/1978 | United Kingdom . |

*Primary Examiner*—Howard N. Goldberg
*Assistant Examiner*—Timothy V. Eley
*Attorney, Agent, or Firm*—Fleit, Jacobson, Cohn & Price

[57] ABSTRACT

In a meat comminuting machine for emulsifying and/or finely comminuting meat into forcemeat, the machine includes an inlet hopper, a conveyor worm including a feed section and a delivery section leading to a cutting device with rotating knives having a considerably greater diameter than the feed section, at least the knives and the delivery section of the conveyor worm are rotated at such a high speed, that these components together with a portion of the machine's housing act as a centrifugal pump with axial entry and exit.

8 Claims, 3 Drawing Figures

COMMINUTING MACHINE, ESPECIALLY FOR EMULSIFYING OR FINE COMMINUTING OF MEAT PRODUCTS

TECHNICAL FIELD

The present invention relates to a fine-comminuting machine, especially for emulsifying or finely comminuting meat products into forcemeat, and of the kind comprising (a) an inlet hopper, (b) a conveying worm situated in said hopper and consisting of a first section or feed section and an exit section and adapted to convey the contents of the hopper through a tubular worm housing towards (c) a cutting device consisting of at least one cutter or knife set cooperating with at least one perforated disc secured in the housing of said cutting device, and wherein (d) at least that cutter or knife set situated closest to said conveyor worm cooperates with that side of the respective perforated disc facing said conveyor worm.

BACKGROUND ART

In machines of this kind the pressure, with which the material from the inlet hopper is fed to the cutting device, depends on certain parameters of the machine and the material, said parameters mainly being of a "static" and not a "dynamic" nature, since they relate to the shape of the conveyor worm and the material's ability to withstand internal shear, as well as its viscosity, if any. It is not possible to increase this feed pressure by increasing the speed of rotation of the conveyor worm, as this will—when a certain speed limit is exceeded—cause the worm to loose its grip on the material and rotate freely in it.

DISCLOSURE OF THE INVENTION

It is the object of the invention to indicate the construction of a machine of the kind referred to above, in which the pressure, with which the material is fed to the cutting device, may be substantially increased as compared to what has hitherto been possible.

The object set forth above is attained by means of a machine, which according to the present invention is characterized in (e) that the radius of the circumcircle of said first cutter or knife set is considerably greater than, e.g. at least approximately twice as large as, the radius of the circumcircle of the feed section of said conveyor worm, (f) that the internal diameter of that portion of the housing of the cutting device surrounding the exit portion of said conveyor worm and said first cutter or knife set increases in the direction of conveying, and (g) that at least the first cutter or knife set and the exit portion of the conveyor worm are adapted to be rotated at such a high speed of rotation, that these components together with the portion mentioned (in subsection f above) of the housing of the cutting device act as a centrifugal pump with axial entry and exit.

This construction makes it possible to attain an increase based on the centrifugal force in the feed pressure mentioned, and thus also an increase in the throughput capacity of the machine.

A useful embodiment of the machine according to the invention is characterized in (a) that the exit portion of said conveyor worm extends into the portion mentioned (in subsection f above) of the housing of the cutting device with a radius increasing in the direction of conveying, roughly corresponding to the increasing internal diameter of this housing portion, and (b) that in at least a portion of said exit section and in continuation of same there is placed a hub adapted to rotate with said worm, the diameter of said hub increasing in the direction of conveying.

With this construction it is possible to avoid excessively sudden changes in the flow cross-sectional areas in the spaces, through which the material moves when it is fed to the first perforated disc.

In certain cases it may be desirable to abandon the centrifugal pumping effect discussed above, and this is possible in an embodiment of the machine according to the invention, which is characterized in that at least the first cutter or knife set and the exit section of the conveyor worm are adapted to be driven with at least one speed of rotation, which is considerably lower than the high speed mentioned (in subsection g above), by means of a directly mechanically coupled electric motor with switchable poles.

The high feed pressure that may be attained by means of the features discussed above could cause problems in sealing the machine's drive shaft, if the seal were placed in a region of high pressure. These problems are avoided in an embodiment of the machine according to the invention, which is characterized in that the drive shaft of the conveyor worm extends through a seal in that wall of the inlet hopper situated opposite the cutting device to the output side of the coupling, the input side of which is coupled to the motor. In this manner the seal will be situated in a region of low pressure, so that the load on the seal becomes correspondingly low.

The construction mentioned in the preceding paragraph involves that the driving motor is situated at a distance from the cutting device. This relationship may be utilized in a machine with two cutter or knife sets and means for adjusting the pressure between the cutter or knife sets and the perforated discs in an embodiment, which is characterized in that the first cutter or knife set is non-rotatably supported on a hollow stub shaft lying in continuation of the shaft of the conveyor worm, said stub shaft being axially movable but non-rotatably supported relative to said worm shaft and having a shoulder surface (the lefthand side of 20 in FIG. 3) facing in the pressure direction of the first cutter set (to the left in FIG. 3), said shoulder surface being able to abut against the side of the first cutter set facing against the pressure direction, said stub shaft being adapted to be axially adjusted relative to said worm shaft by means of an externally accessible adjusting screw in threaded engagement with the stub shaft and with its end surface directly or indirectly pressing against an end surface in or on the shaft of said worm, said shaft being rotatably supported in at least one bearing capable of withstanding the reaction forces from the pressure of the first cutter or knife set against the perforated disc cooperating therewith.

With this construction it is possible to attain that the pressure or force between the first cutter or knife set and the perforated disc, with which it cooperates, may be adjusted without it being necessary to open the machine.

A corresponding facility for adjusting the pressure or force between the second cutter or knife set and the second perforated disc may be obtained in a further development of the machine characterized in that the second cutter or knife set is non-rotatably supported on the stub shaft, and that the second perforated disc cooperating with the second cutter or knife set is axially movably, but non-rotatably supported in the housing of the cutting device, said housing carrying an axially adjustable pressure member adapted to abut against the exit side (to the left in FIG. 3) of the second perforated disc.

As is well known, it is important that a machine for processing perishable goods, such as forcemeat and the like, should be capable of being dismantled for thorough cleaning. With the machine according to the invention this may be attained by a further development characterized in (a) that the stub shaft is axially removably supported in a bore in the shaft of the conveyor worm, (b) that the first and the second cutter or knife set are axially movably and axially removably supported on the stub shaft, possibly together with a distance member, (c) that the axially adjustable pressure member is constituted by a ring removably placed in the housing of the cutting device, said ring partly and through a number of radial arms or spokes carrying a bearing for the end of the stub shaft facing away from the shaft of the conveyor worm, partly through a removable screw ring in threaded engagement with the housing of the cutting device and axially adjustable relative thereto being capable of being held against the exit side of the second perforated disc, and (d) that the housing of the cutting device consists of two sections, viz. a first section with a diameter increasing in the direction of conveying, and a second, generally cylindrical section, in which the perforated discs and the pressure member are situated, said two sections being adapted to be mutually removably secured, e.g. by means of a clamping ring with conical abutment surfaces.

This construction makes it possible to dismantle the machine's cutting device with ease and without the use of tools, even for unskilled personnel.

BRIEF DESCRIPTION OF THE DRAWING

The invention will be explained in more detail below with reference to the embodiment of a fine-comminuting machine according to the invention shown in the drawing, in which.

BEST MODE OF CARRYING OUT THE INVENTION

Figure 2:
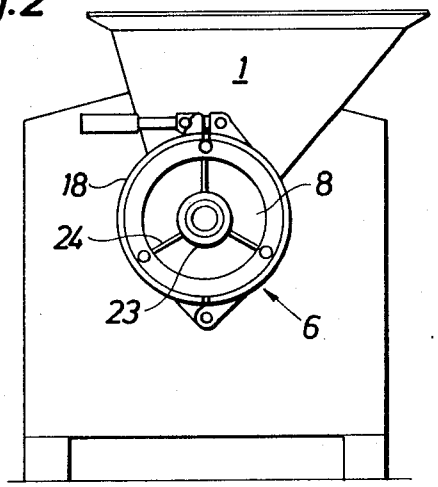
FIG. 2 shows the machine as viewed in the direction of the arrow II in FIG. 1.
Figure 1:
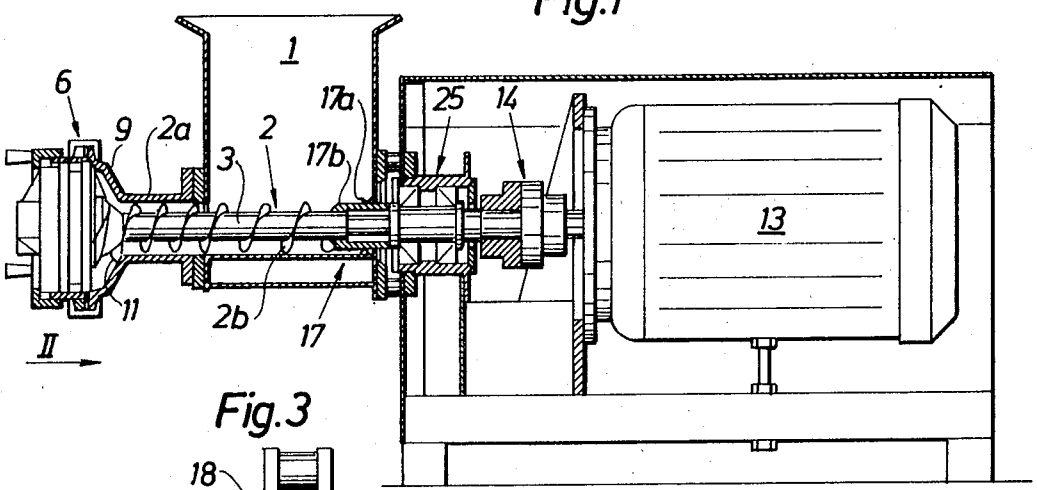
FIG. 1 shows a side elevation of the machine, partly in section through a vertical longitudinal plane of symmetry.

As is evident from FIG. 1, the machine according to the invention comprises an inlet hopper 1, in the bottom region of which a first section 2b of a conveyor worm 2 is situated. The first section 2b of the conveyor worm 2, which may also be designated as the feed section of the worm, conveys material that has been introduced into the inlet hopper 1, such as coarsely comminuted meat to be comminuted further or emulsified, from the hopper 1 through a tubular worm housing 2a to a cutting device 6.

The cutting device 6 consists in a known manner of a number of cutter or knife sets with associated perforated discs—in the example shown two cutter sets 4 and 5, which are adapted to rotate together with the worm 2, as well as two perforated discs 7 and 8 cooperating with the cutter sets and being held non-rotatably in the housing 9, 10 of the cutting device 6. The housing of the cutting device consists of a first, divergent housing section 9, which in the example shown is integral with the worm housing 2a, and a second and generally cylindrical housing section 10 held releasably clamped to the first housing section 9 by a two-part clamping ring 18 with conical clamping surfaces.

The shaft 3 of the conveyor worm 2 is connected to the output shaft of a motor 13 by means of a coupling 14, which may constitute a highly elastic coupling or a slip coupling or maximum-release coupling. In the preferred example shown there is no speed increase or decrease between these parts, as the motor 13 is a motor with switchable poles, which can run with at least two different speeds of rotation.

The transition region between the conveyor worm 2 and the cutting device 6 comprises the divergent housing section 9 mentioned above as well as the exit section 11 of the conveyor worm 2, contiguous with the feed section 2b, but shaped with an increasing radius generally corresponding to the manner, in which the housing section 9 diverges in the direction of conveying. Inside the exit section there is a hub 12 adapted to rotate together with the shaft 3 of the conveyor worm 2 and generally constituting a divergent continuation of same in the direction of conveying.

Rotation of the shaft 3 of the conveyor worm 2 by means of the motor 13 results in a known manner in that material situated in the inlet hopper 1 will be conveyed through the worm housing 2a towards the cutting device 6. This conveying effect is based on the shape of the worm and on the inner cohesion and viscosity of the material, and the pressure, with which the material is fed to the first cutting means consisting of the cutter set 4 and the associated perforated disc 7, will normally be limited by these parameters. According to the invention, however, the machine exhibits a further feature permitting a considerable increase in the feed pressure mentioned by using a sufficiently high speed of rotation. This feature is the divergent shape of the housing section 9 and the exit section 11 placed therein as well as the hub 12, and this feature involves that the components mentioned cooperate in the same manner as the housing or stator and the rotor respectively in a centrifugal pump with axial inlet and outlet. In the region immediately in front of the first cutter means 4,7—i.e. in FIGS. 1 and 3 immediately to the right of said cutting means—the hydrostatic pressure will be considerably higher than in previous machines of the same type, and—since the cutter set 4 also rotates at a high speed—the throughput capacity of the machine will be substantially increased as compared to previous machines without this centrifugal effect.

As examples of parameters used in actual practice the following may be mentioned:

Diameter of the feed section 2b of the worm = 115 mm

Diameter of perforated discs 7 and 8 = 300 mm

Diameter of cutter sets 4 and 5 = 260 mm

Speed of rotation for the worm 2 = max. 2950 r.p.m.

Volume of inlet hopper 1 = 100 liters

It will, of course, be necessary to have a seal in the place, where the shaft 3 of the conveyor worm 2 extends through the wall of the inlet hopper 1, and this is attained by means of a seal 17, which in the example shown consists of a lip 17*a* of synthetic rubber fixed to the hopper wall and cooperating with a smooth ferrule 17*b* fixed to and rotating with the shaft 3. Since the location of the seal—in contradistinction to what is the case in many previously known machines—is not in the zone of high pressure within the cutting device 6, but opposite this in a place in the hopper 1, where the pressure—due to the effect of the worm 2—is very low, the load on the seal 17 is extremely small. For this reason, the lip 17*a* may also be in the form of an inwardly extending integral part of the wall of the hopper 1, with a close sliding fit against the ferrule 17*b*.

A hollow stub shaft 19 is inserted with a close sliding fit in a bore made for this purpose in the end of the shaft 3 and the hub 12 connected therewith, said stub shaft 19 being adapted to be driven by the shaft 3, by means of a key-and-slot connection (not shown). The stub shaft 19 has an annular flange 20 abutting against the upstream side of the cutter set 4 and thus holding same in contact with the perforated disc 7. The contact pressure may be adjusted by means of an adjusting screw 15 screwed into a threaded bore in the innermost end of the stub shaft 19 and with its end surface pressing axially against the shaft 3 through a thrust bearing block 15*a*. The adjusting screw 15 may be adjusted with a screwdriver inserted through the hollow stub shaft 19 through the opening facing left in FIG. 3. The thrust bearing block 15*a* may be made springy or elastically resilient by using suitable means (not shown). Between the downstream side of the cutter set 4 and the upstream side of the cutter set 5 an intermediate ring 21 is interposed on the stub shaft 19 and adapted to hold the second cutter set 5 in contact with the perforated disc 8, the contact pressure between the two last-mentioned parts in addition being adjustable by means of a pressure ring 16 with handles 16*a*, screwed onto the outside of the cylindrical housing section 10 and adapted to press a thrust ring 22 placed inside the housing section 10 against the downstream side of the perforated disc 8. The perforated discs 7 and 8 and the thrust ring 22 are prevented from rotating in the housing section 10, and the cutter sets 4 and 5 are held against rotation on the stub shaft 19, by shape-engaging means of known types, some of which can be discerned on the drawing, but which do not require further explanation or description, as persons skilled in this art will have sufficient knowledge of the construction of such means to design them if and when need arises.

The outermost end of the stub shaft 19—i.e. the end farthest to the left in the drawing—is rotatably supported in a bearing 23, carried by the thrust ring 22 by means of radial arms or spokes 24. The opposite end of the shaft 3 of the conveyor worm 2 is—inside of the coupling 14 and outside of the seal 17—rotatably supported by a bearing 24 adapted to withstand the axial thrust forces, with which the cutter sets 4 and 5 are held in contact against the perforated discs 7 and 8 respectively.

Figure 3:
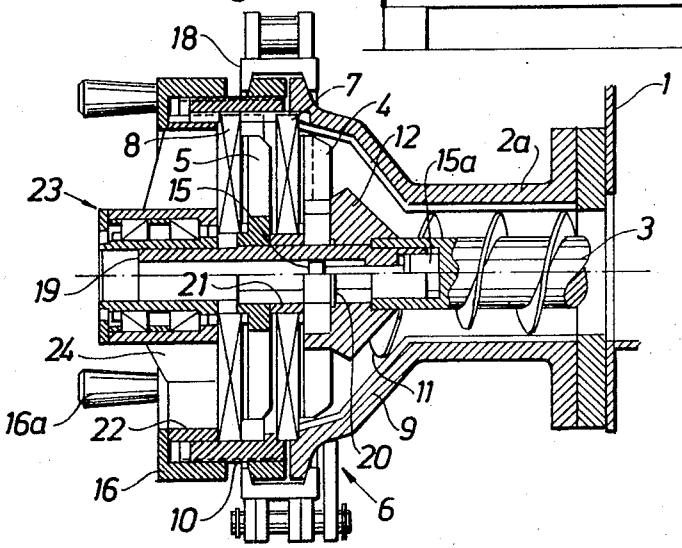
FIG. 3 is a longitudinal section on an enlarged scale of a part of the machine.

During high speed operation the high pressure produced will, of course, be propagated through the cutter sets 4 and 5 and the perforated discs 7 and 8 towards the outside of the machine, i.e. the left-hand side in FIGS. 1 and 3. This pressure may be utilized, e.g. for the further conveying of the comminuted meat or the like having been processed, or for the filling of cans (tins) or sausage skins, by placing a pipe coupling member (not shown) opposite the exit side of the last perforated disc 8, said coupling member connecting the region outside this perforated disc in a fluid-tight manner with a conveyor tube, pipe or hose or a sausage stuffing horn or tube. Such a pipe coupling member could be arranged to engage the pressure ring 16 in a fluid-tight manner immediately inside of its handles 16*a*.

I claim:

1. A fine-comminuting machine, especially for emulsifying or finely comminuting meat products into forcemeat, said machine comprising:

an inlet hopper, a conveying worm located in said inlet hopper and including a feed section and an exit section, a tubular worm housing extending from said inlet hopper, a cutting device housing extending from said tubular worm housing, said conveying worm conveying meat products from said inlet hopper through said tubular worm housing to said cutting device housing, a cutting device located in said cutting device housing, said cutting device housing including at least one cutter set cooperating with at least one perforated disc secured in said cutting device housing, one cutter set located closest to said conveying worm cooperates with a side of one respective performated disc located facing said conveying worm, a radius of a circumcircle of said one cutter set being at least approximately twice as large as a radius of a circumcircle of said feed section of said conveying worm, and an internal diameter of a portion of said cutting device housing surrounding said exit section of said conveying worm and said one cutter set increases in the direction of conveying, and said one cutter set and said exit section of said conveying worm are rotated at such a speed of rotation that said one cutter set and said exit section together with said portion of the cutting device housing act as a centrifugal pump with axial entry and exit.

2. A machine as claimed in claim 1, wherein said exit section of said conveying worm extends into said portion of said cutting device housing with a radius increasing in the direction of conveying, corresponding to said increasing internal diameter of said portion of said housing, and a hub located on at least a portion of said exit section rotates with said conveying worm, the diameter of said hub increasing in the direction of conveying to avoid an excessive sudden change in flow cross sectional area as said meat products move from said feed section of said conveying worm to said cutting device housing.

3. A machine as claimed in claim 2, wherein said one cutter set and said exit section of said conveying worm are driven with at least one speed of rotation, which is considerably lower than said speed of rotation by means of a directly mechanically coupled electric motor with switchable

4. A machine as claimed in claim 3, wherein said one cutter set is directly mechanically coupled to said electric motor and said mechanical coupling is highly elastic and includes a slip coupling.

5. A machine as claimed in claim 3, wherein said one cutter set is directly mechanically coupled to said electric motor and said mechanical coupling includes a slip coupling.

6. A machine as claimed in claim 3, wherein said one cutter set is directly mechanically coupled to said electric motor and said mechanical coupling includes an overload-protected coupling.

7. A machine as claimed in claim 3, wherein said one cutter set is directly mechanically coupled to said electric motor and said mechanical coupling is highly elastic and includes an overload-protected coupling.

8. A fine-comminuting machine, especially for emulsifying or finely comminuting meat products into forcemeat, said machine comprising:

an inlet hopper, a conveying worm located in said inlet hopper and including a feed section and an exit section, a tubular worm housing extending from said inlet hopper, a cutting device housing extending from said tubular worm housing, said conveying worm conveying meat products from said inlet hopper through said tubular worm housing to said cutting device housing, a cutting device located in said cutting device housing, said cutting device housing including at least one cutter set cooperating with at least one perforated disc secured in said cutting device housing, one cutter set located closest to said conveying worm copperates with a side of one respective perforated disc located facing said conveying worm, a radius of a circumcircle of said one cutter set being greater than a radius of a circumcircle of said feed section of said conveying worm, and an internal diameter of a portion of said cutting device housing surrounding said exit section of said conveying worm and said one cutter set increases in the direction of conveying, and said one cutter set and said exit section of said conveying worm are rotated at such a speed of rotation that said one cutter set and said exit section together with said portion of the cutting device housing act as a centrifugal pump with axial entry and exit.

* * * * *

UNITED STATES PATENT AND TRADEMARK OFFICE

CERTIFICATE OF CORRECTION

PATENT NO. : 4,606,505

DATED : August 19, 1986

INVENTOR(S) : Knud SIMONSEN

It is certified that error appears in the above-identified patent and that said Letters Patent is hereby corrected as shown below:

Please correct the claims as follows:

Column 6, Claim 3:

line 62, after "switchable" insert -- poles. --.

Column 8, Claim 8:

line 8, change "copperates" to -- cooperates --.

Signed and Sealed this

Twenty-seventh Day of January, 1987

*Attest:*

DONALD J. QUIGG

*Attesting Officer* *Commissioner of Patents and Trademarks*